US006123004A

United States Patent [19]

Matz

[11] Patent Number: 6,123,004

[45] Date of Patent: Sep. 26, 2000

[54] BREAD SLICER

[75] Inventor: Vance J. Matz, Cedar Springs, Mich.

[73] Assignee: Oliver Products Company, Grand Rapids, Mich.

[21] Appl. No.: 09/388,963

[22] Filed: Sep. 2, 1999

[51] Int. Cl.[7] ..... B27B 3/00

[52] U.S. Cl. ..... 83/699.21; 83/783; 83/932; 83/954; 83/751

[58] Field of Search ..... 83/698.11, 698.71, 83/699.21, 932, 954, 750, 751, 782, 783, 746, 167, 437.6, 581.1, 662, 425.3, 427, 431, 697, 602, 604, 597, 620, 628, 630, 632; 403/17, 321, 322.1, 323, DIG. 4, DIG. 8, DIG. 9; 279/35, 66, 71, 77, 81, 84

[56] References Cited

U.S. PATENT DOCUMENTS

| | | | |
|---|---|---|---|
| 1,829,079 | 10/1931 | Young et al. | 83/699.21 X |
| 2,095,620 | 10/1937 | Tuthill et al. . | |
| 2,147,322 | 2/1939 | Tuthill et al. . | |
| 2,315,761 | 4/1943 | Ahrndt | 83/751 X |
| 2,721,587 | 10/1955 | Dremel | 83/699.21 X |
| 3,242,779 | 3/1966 | Mona | 83/751 X |
| 3,901,116 | 8/1975 | Broccardo et al. | 83/751 |
| 5,363,733 | 11/1994 | Baird et al. | 83/662 X |
| 5,409,321 | 4/1995 | Chen | 403/321 |
| 5,941,153 | 8/1999 | Chang | 83/698.71 X |
| 5,992,283 | 11/1999 | Chen | 83/783 X |

*Primary Examiner*—M. Rachuba
*Assistant Examiner*—Boyer Ashley
*Attorney, Agent, or Firm*—Price, Heneveld, Cooper, DeWitt & Litton

[57] ABSTRACT

A bread slicing machine having blade frames and blades readily removable without wrenches or other tools, clamps between the blade frames and drive mechanism for removably securing the blade frames to the drive mechanism, the clamps each comprising a T-shaped cam stud, a pivotal cam receiving the cam stud, and an actuator handle; cam-engaging members on the blade frames adjacent the cam studs and engaged by the pivotal cams, the actuator handles being shiftable to pivot the cams relative to the cam engaging members to cause the cam studs to secure or release the blade frames. The pivotal cams each have a vertical slot and a cross slot to receive the T-shaped cam stud.

4 Claims, 4 Drawing Sheets

BREAD SLICER

BACKGROUND OF THE INVENTION

This invention relates to bread slicing machines, particularly commercial-type bread slicing machines having a plurality of slicing blades.

Bread slicing machines have been known and available for many years as set forth, for example, in U.S. Pat. Nos. 2,095,620 and 2,147,322, both incorporated herein by reference. Such machines have two sets of blades, each being a plurality of slicing blades vertically arranged parallel to each other mounted on a blade frame. The two sets reciprocate up and down in opposite directions to each other. The ends of the blades are secured to the blade frames. The blade frames are attached to a reciprocating drive mechanism such as a rocker drive to create the cutting action on a loaf of bread fed through the machine.

Maintaining sanitation in these machines is essential. The bread crumbs penetrate crevices, cracks and recesses in the apparatus, including those in the blade frames and around the ends of the blades. Cleaning out these blades and blade frames is not readily accomplished with the conventional bread slicing machines. The apparatus has to be carefully unbolted and taken apart in a time-consuming operation. The blade frame and blades should be disassembled from the remaining apparatus in order to most effectively and thoroughly clean the blade frames and blades, and the remainder of the apparatus. This requires use of wrenches or other tools for disassembly of the bolts mounting the blade frames in the machine, cleaning the apparatus, and then reassembling the bolted apparatus with the same tools or wrenches. Because of this time-consuming procedure, there is the temptation to neglect this important task, to the detriment of the public.

SUMMARY OF THE INVENTION

This invention comprises a bread slicing machine which incorporates all of the essential components for optimum and safe bread slicing, but which enables ready removal of the blade frames and blades without requiring any tools or wrenches. The blade frames can be removed without tools in a matter of seconds for sanitary cleaning purposes, and readily reassembled into the apparatus without tools, thereby enabling frequent cleaning. The blade frames are retained in position by cam locking clamps pivotally operable to either release the blade frames for removal or re-secure the blade frames for bread slicing.

DESCRIPTION OF THE PREFERRED EMBODIMENT

Figure 1:
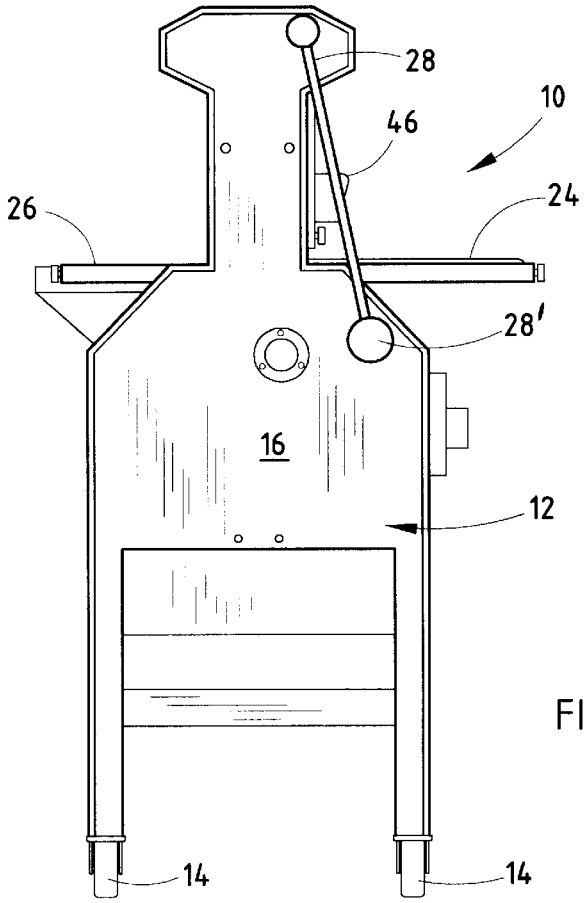
FIG. 1 is an end elevational view of the bread slicer apparatus.
Figure 2:
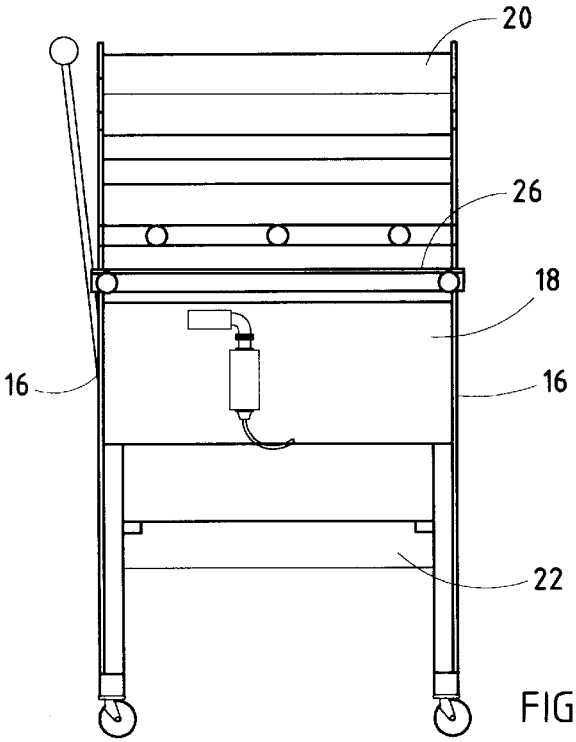
FIG. 2 is a rear elevational view of the discharge side of the bread slicer apparatus.
Figure 3:
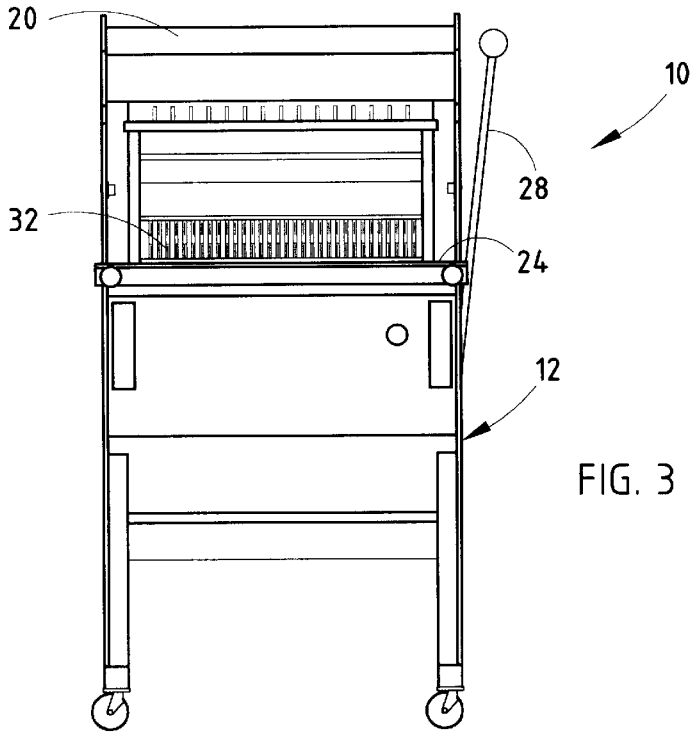
FIG. 3 is a front elevational view of the infeed side of the bread slicer apparatus.
Figure 4:
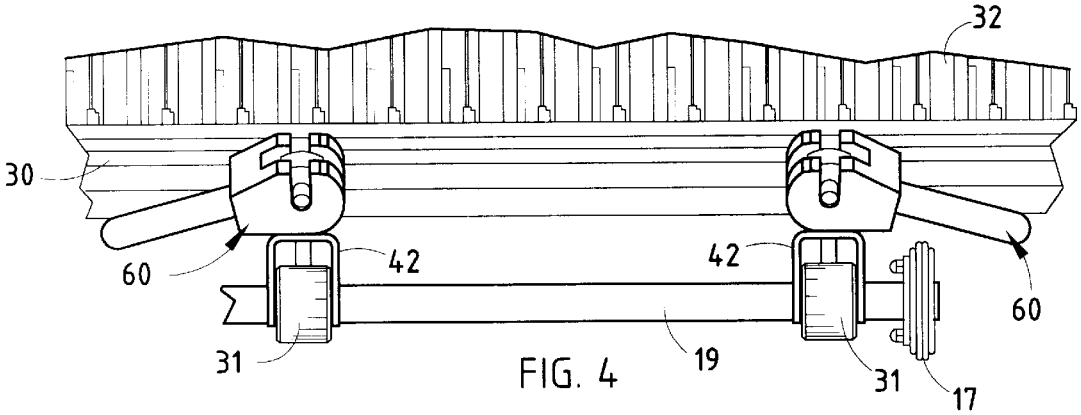
FIG. 4 is a fragmentary, enlarged, perspective view of the double cam lock mechanism on the front of the bread slicer apparatus.

Referring now the specially to the drawings, the bread slicer apparatus 10 there depicted comprises an upright support structure 12 optionally mounted on wheels 14, having a pair of opposite ends 16 interconnected by and secured together by front and rear panels 18, top cover panel 20, and lower brace member 22.

Figure 5:
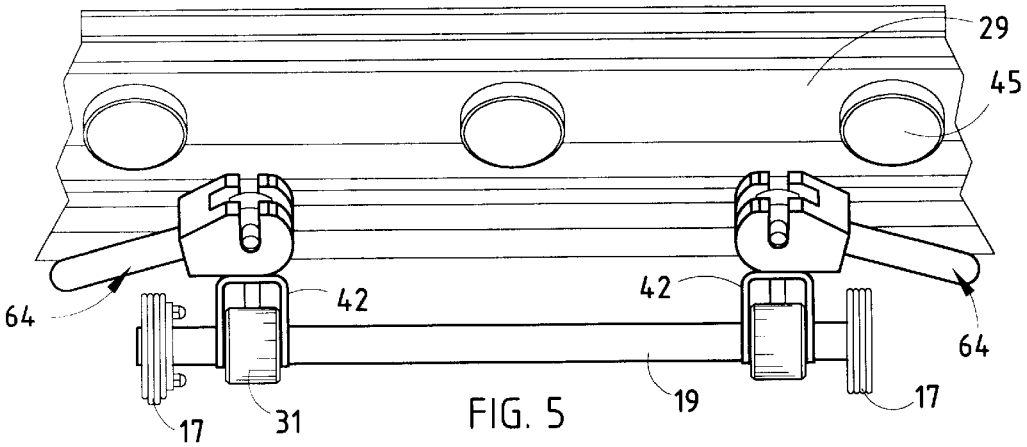
FIG. 5 is a fragmentary, perspective view of the double cam lock mechanism on the rear of the bread slicer apparatus.

Extending from the front of the bread slicer apparatus is a bread support infeed table 24 which may be generally horizontal in orientation or optionally sloped downwardly inwardly as desired. Extending out the rear of the apparatus is a discharge bread support table 26. A loaf of bread may be fed into the bread slicer blades by a manual control handle 28 pivotally mounted to a shaft at it lower end 28 to operate a conventional pusher 29 not shown in detail. Positioned between the infeed and outfeed tables is a pair of vertically oriented, vertically reciprocal, blade frames 30, each mounting a plurality of vertically arranged, parallel, spaced, cutting blades 32 of typical type used on bread slicers. The two blade frames and sets of blades are spaced from each other, the lower ends being mounted on opposite ends of conventional rocker mechanism like that disclosed in U.S. Pat. No. 2,095,620, incorporated by reference herein. This conventional blade mounting arrangement and rocker serve to vertically reciprocate the two sets of blades and two blade frames in opposite directions so as to apply a generally balanced force to the bread loaf being sliced. Preferably a conventional bread loaf hold down plate 46 engages the top of the bread loaf when it is sliced, this being actuated by the control lever 28. Lever operates a conventional bread pusher 29 (FIG. 5) held by screw knobs 45.

Figure 9:
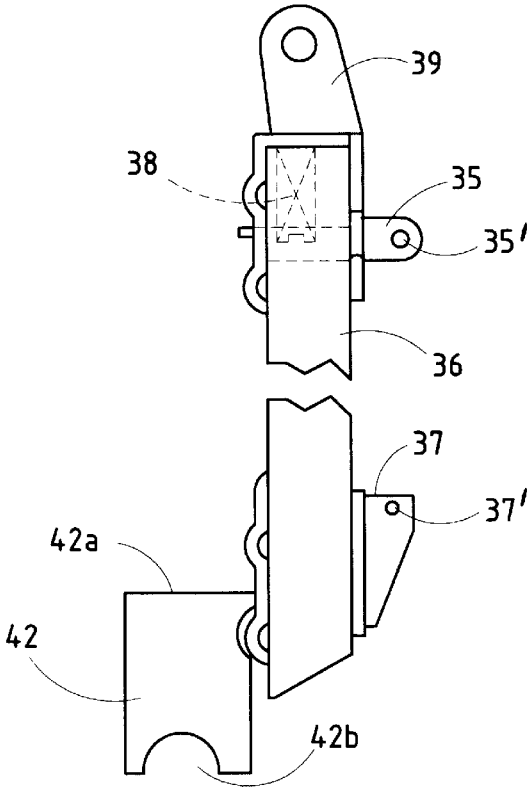
FIG. 9 is an end elevational view of a blade frame for the bread slicer.
Figure 10:
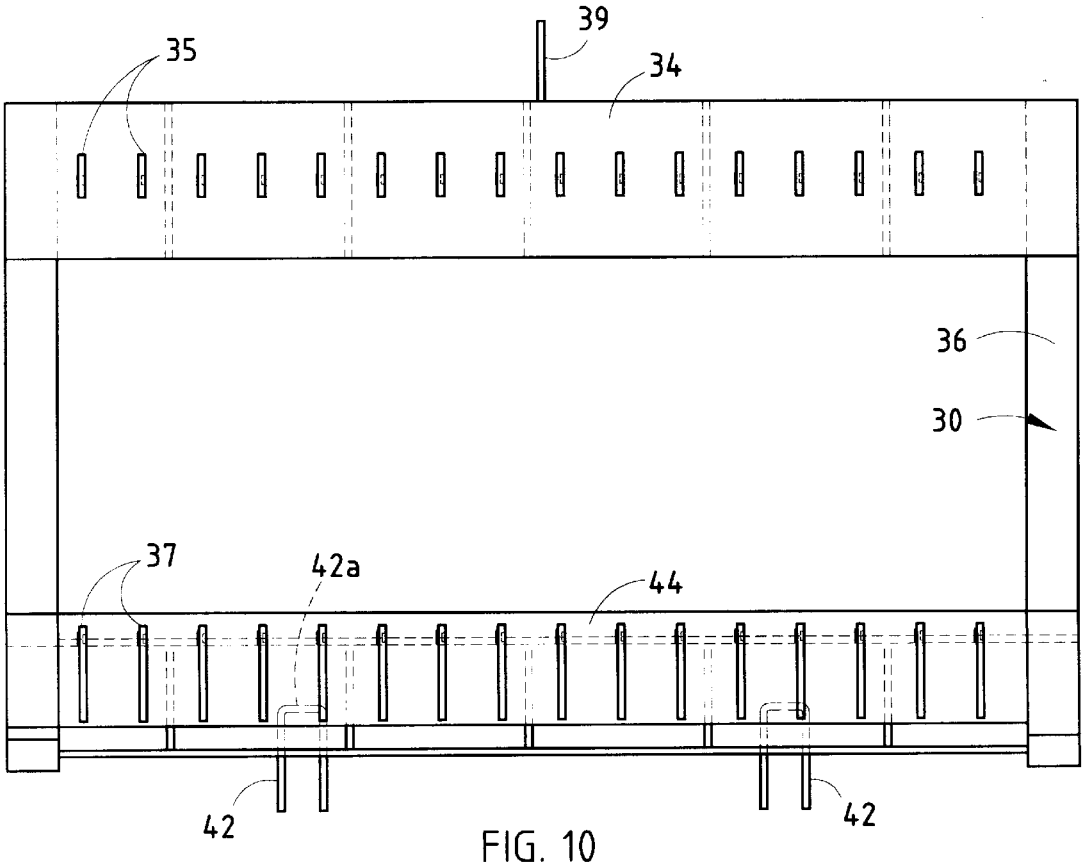
FIG. 10 is a front elevational view of a blade frame for the bread slicer.

Each blade frame 30 is composed of upper and lower, horizontally extending frame elements 34, and 44, respectively interconnected by vertically arranged, parallel side elements 36 (FIG. 10). The upper and lower elements 34, include a plurality of blade mounting devices to hold the plurality of vertically arranged blades 32. Specifically, the upper elements 34 include a plurality of spaced adjacent tabs 35 (FIG. 9) having pins 35' to engage the upper ends of the blades, while lower elements 44 include a plurality of spaced, adjacent tabs 37 aligned with tabs 35 and having pins 37' to engage the lower ends of the blades. A tensioning spring 38 creates blade tension. Also an ear 39 at the top center of frame 30 may be pinned by a removable horizontal stud to a rocking link at the top of the slicer, as in U.S. Pat. No. 2,095,620. All of this structure is conventional.

Attached to lower member 44 as by weldment is a pair of inverted-U-shaped clamping brackets 42 (FIGS. 9 and 10) spaced from each other. Each of these brackets includes an upper clamp surface 42*a* which is the horizontal cross leg of the bracket. The lower ends of the two vertical legs of each bracket include a concave recess 42*b*.

Figure 6:
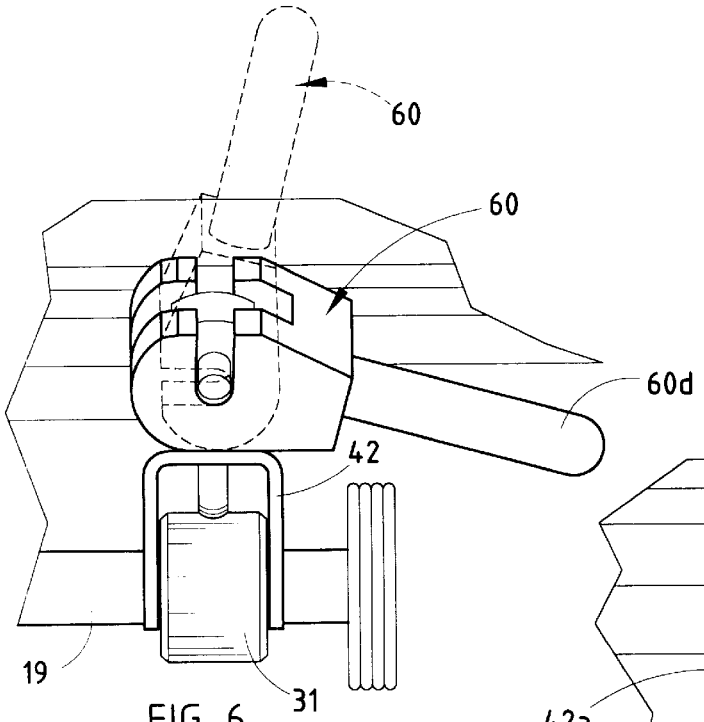
FIG. 6 is an enlarged, perspective view of one of the cam lock devices, shown in the lock down position and in the release position.
Figure 7:
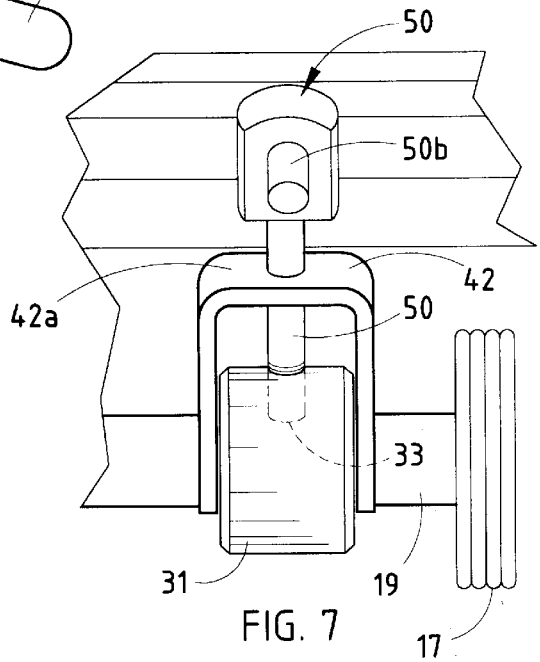
FIG. 7 is an enlarged, fragmentary, perspective view of one of the cam lock mechanisms with the cam itself removed for purposes of clarity.
Figure 8:
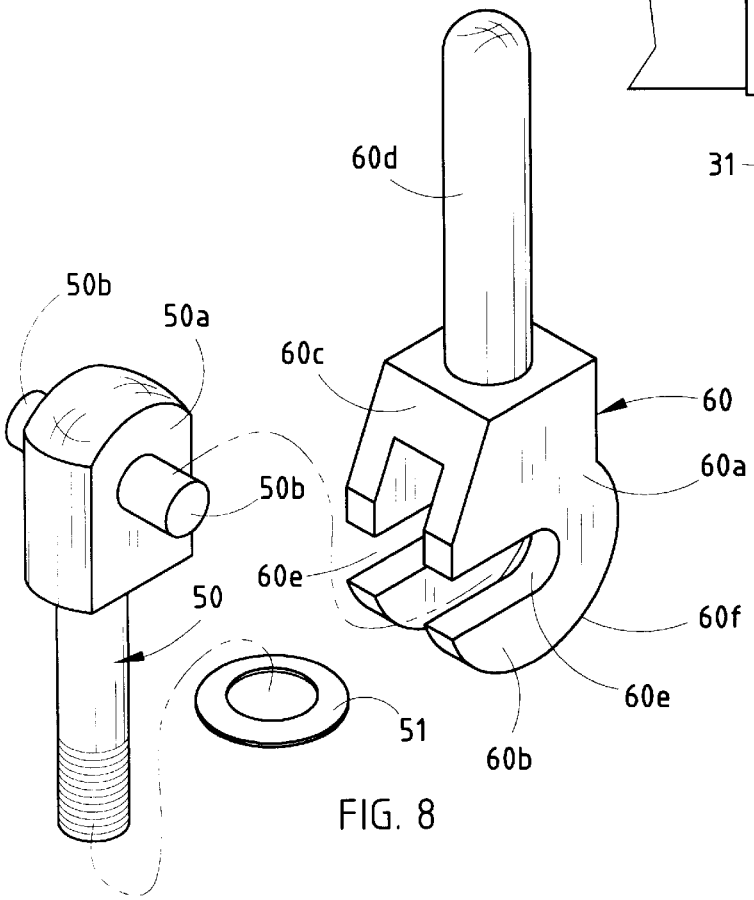
FIG. 8 is a perspective, exploded view of the cam lock components.

The rocker arm 17 which vertically oscillates the blade frames and blades has a pair of rocker rods 19 comparable to those of the above-mentioned U.S. Pat. No. 2,095,620. Positioned on each of these rocker rods 19 is a pair of cylindrical collars 31 oriented and positioned so that the inverted U-shaped bracket members 42 straddle the respective collars 31 in the manner depicted in FIGS. 6 and 7. The blade frames are locked in place by clamps 64 against brackets 42. Each of the collars 31 has a radially oriented threaded socket 33 (FIG. 7) receiving the threaded lower end of a T-shaped cam stud 50 (FIGS. 6–8). A machine washer 51 is located about the lower end of each stud 50. The upper end of this T-shaped cam stud includes an enlarged head 50*a* and a cross pin 50*b* cylindrical in cross section so as to extend out the opposite sides of head 50*a*. Pin 50*b* may be integral with head 50*a* or may be inserted into head 50*a*. Engaging the two horizontally oppositely extending ends of cross pin 50*b* is a pivotal lever cam 60. This cam includes a camming head 60*a* which is comprised of a pair of spaced parallel legs or walls 60*b* and an integral connecting portion 60*c* therebetween, as well as a radially extending lever 60*d* which extends from head 60*a*. Legs 60*b* include open-ended slots 60*e*, the two slots being parallel and aligned with each other so as to receive the cylindrical ends 50*b* of bolt 50 in the manner depicted in FIG. 6. Each slot 60*e* has a concave inner end of a radius generally corresponding that of element 50*b*. The outer convex curvilinear surface 60*f* on each leg 60*b* is eccentric to form a camming surface. This camming surface of each cam engages upper cam follower surface 42*a* of a respective bracket 42. The cam 60 can be rotated relative to pins 50*b* between a release position shown in phantom lines in FIG. 6 and a rotated locking position depicted in solid lines in FIG. 6. The cam is assembled to the T-bolt by sliding the cam toward the pins 50*b* with the open end of slots 60*e* oriented toward the pins so that pins 50*b* become inserted into slots 60*e*. Pressing down on cam handles 60*d* rotates the cam so that the cam surfaces 60*f* press down upon brackets 42 due to the cam eccentricity, thereby binding and securing the blade frame 30 to the rocker shaft 19. When the bread slicer is actuated by the conventional power motor (not shown), rocker 17 vertically oscillates so as to vertically reciprocate rocker shafts 19, to thereby vertically reciprocate the two brackets 42 on each rocker shaft and thus the blade frames 30 and their contained blades 32, for slicing the load of bread fed through the machine.

Advantageously, the blades and blade frames can be readily and quickly removed from the remainder of the apparatus simply by raising handles 60*d* to pivotally unlock cams 60, sliding the cams away from cam studs 50 and brackets 42 to free the blade frames, removing the top stud from blade frame ear 39, and lifting the blade frames 30 with brackets 42 away from the rocker shafts 19, to be readily cleaned and sterilized. The remainder of the machine can be cleaned and sterilized also, followed by replacement of the blades and blade frames by inserting them, re-installing the cam elements, and rotating the cams to their locking positions.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

What is claimed is:

1. A bread slicing machine comprising:

an infeed table, an outfeed table positioned adjacent said infeed table, and a pair of vertically oriented blade frames between said tables, each blade frame having a plurality of vertical, parallel, spaced bread slicing blades, and a drive mechanism operably connected with said blade frames for vertically reciprocating said blade frames and blades;

a plurality of clamps between said blade frames and said drive mechanism for removably securing said blade frames to said drive mechanism, said clamps each comprising a T-shaped cam stud, a pivotal cam receiving said cam stud, and an actuator handle;

cam engaging members on said blade frames adjacent said cam studs and engaged by said pivotal cams, said actuator handles being shiftable to pivot said cams relative to said cam engaging members to cause said cam studs to secure or release said blade frames.

2. The bread slicing machine in claim 1 wherein said pivotal cams each have a vertical slot and a cross slot to receive said T-shaped cam stud.

3. The bread slicing machine in claim 2 wherein said pivotal cams each have a peripheral exterior and said cross slot is open to said peripheral exterior for interengagement with and separation of said cam with said T-shaped cam stud.

4. The bread slicing machine in claim 2 wherein said T-shaped cam studs each have a threaded stem and a cross member, said actuator handles extending generally normal to said cross members, and said machine including a pair of rocker bars, one adjacent each of said blade frames, collars on each said rocker bars, and said threaded stems of said T-shaped cam studs being threadably engaged with said collars.

* * * * *

UNITED STATES PATENT AND TRADEMARK OFFICE

CERTIFICATE OF CORRECTION

PATENT NO. : 6,123,004
DATED : September 26, 2000
INVENTOR(S) : Vance J. Matz

It is certified that error appears in the above-identified patent and that said Letters Patent is hereby corrected as shown below:

Column 2,
Line 11; "the specially" should be --specifically--;
Line 23; "it" should be --its--;
Line 23; "lower end 28" should be "lower end 28′"; and
Line 44; "34" insert --and 44, respectively--.

Signed and Sealed this

Seventeenth Day of July, 2001

Nicholas P. Godici

*Attest:*

NICHOLAS P. GODICI
*Acting Director of the United States Patent and Trademark Office*

*Attesting Officer*